US006854726B2

(12) United States Patent
Acton et al.

(10) Patent No.: US 6,854,726 B2
(45) Date of Patent: Feb. 15, 2005

(54) IMAGING APPARATUS INCLUDING A PRINT MEDIA FEED SYSTEM CONFIGURED FOR REDUCING PRINTING DEFECTS

(75) Inventors: Larry W. Acton, London, KY (US); William M. Connors, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 206 days.

(21) Appl. No.: 10/310,762

(22) Filed: Dec. 6, 2002

(65) Prior Publication Data

US 2004/0108646 A1 Jun. 10, 2004

(51) Int. Cl.[7] ..... B65H 5/06

(52) U.S. Cl. ..... 271/274; 400/577; 400/636

(58) Field of Search ..... 271/269, 271, 271/272, 273, 274; 400/577, 636; 74/409, 440

(56) References Cited

U.S. PATENT DOCUMENTS

| | | | | |
|---|---|---|---|---|
| 3,749,221 A | * | 7/1973 | Busch | 400/620 |
| 3,803,935 A | | 4/1974 | Nozawa | 74/409 |
| 4,036,074 A | | 7/1977 | Bodnar | 74/409 |
| 4,072,064 A | | 2/1978 | Lloyd et al. | 74/409 |
| 4,110,068 A | | 8/1978 | Brown et al. | 432/60 |
| 4,189,951 A | | 2/1980 | Sauter | 74/440 |
| 4,205,323 A | | 5/1980 | Williams et al. | 346/165 |
| 4,269,522 A | | 5/1981 | Levinson et al. | 400/616.1 |
| 4,305,307 A | | 12/1981 | Kiunke | 74/409 |
| 4,331,040 A | | 5/1982 | Swasey | 74/409 |
| 4,533,074 A | | 8/1985 | Van Thiel | 226/74 |
| 4,554,842 A | | 11/1985 | Wood, III | 74/409 |
| 4,662,767 A | | 5/1987 | Pimintel | 400/616.2 |
| 4,714,388 A | | 12/1987 | Siler | 409/146 |
| 4,747,321 A | | 5/1988 | Hannel | 74/440 |
| 4,805,475 A | | 2/1989 | Hannel | 74/440 |
| 4,930,916 A | * | 6/1990 | Fujiwara | 400/636 |
| 5,161,424 A | | 11/1992 | Saberton et al. | 74/409 |
| 5,399,039 A | | 3/1995 | Giles et al. | 400/636 |
| 5,406,316 A | | 4/1995 | Schwiebert et al. | 347/18 |
| 5,406,321 A | | 4/1995 | Schwiebert et al. | 347/102 |
| 5,456,543 A | | 10/1995 | Witte et al. | 400/577 |
| 5,461,408 A | | 10/1995 | Giles et al. | 347/102 |
| 5,479,199 A | | 12/1995 | Moore et al. | 347/102 |
| 5,500,667 A | | 3/1996 | Schwiebert et al. | 347/102 |
| 5,581,289 A | | 12/1996 | Firl et al. | 347/104 |
| 5,633,668 A | | 5/1997 | Schwiebert et al. | 347/102 |
| 5,729,100 A | | 3/1998 | Rothstein et al. | 317/7 |
| 5,979,260 A | | 11/1999 | Long et al. | 74/440 |
| 6,148,684 A | | 11/2000 | Gardiner | 74/440 |
| 6,247,377 B1 | | 6/2001 | Long et al. | 74/440 |
| 6,568,674 B2 | * | 5/2003 | Matsuda | 271/274 |
| 6,768,663 B2 | * | 7/2004 | Ogata | 365/63 |

OTHER PUBLICATIONS

Precision Gearing: Theory and Practice, by George W. Michalec, John Wiley & Sons, New York, 1966, pp. 262–265.

* cited by examiner

*Primary Examiner*—Khoi H. Tran
(74) *Attorney, Agent, or Firm*—Ronald K. Aust

(57) ABSTRACT

An imaging apparatus includes a motor including a motor shaft to which a pinion gear is attached, and a feed roller including a shaft. The feed roller is positioned upstream from the print zone in relation to the sheet feed direction. A primary gear train includes a first gear in mesh with the pinion gear and a second gear rigidly mounted to the shaft of the feed roller. A spring coupling has a first end connected to the second gear of the primary gear train. A secondary gear train includes a third gear in mesh with the pinion gear and a fourth gear rotatably mounted to the shaft of the feed roller for free rotation with respect to the shaft, the second end of the spring coupling being connected to the fourth gear of the secondary gear train.

8 Claims, 3 Drawing Sheets

IMAGING APPARATUS INCLUDING A PRINT MEDIA FEED SYSTEM CONFIGURED FOR REDUCING PRINTING DEFECTS

BACKGROUND OF THE INVENTION

1. Field of the Invention

The present invention relates to an imaging apparatus, and more particularly, to an imaging apparatus including a print media feed system configured for reducing printing defects.

2. Description of the Related Art

A typical ink jet printer forms an image on a print medium by ejecting ink from a plurality of ink jetting nozzles of an ink jet printhead to form a pattern of ink dots on the print medium. Such an ink jet printer typically includes a reciprocating printhead carrier that transports one or more ink jet printheads across the print medium along a bi-directional scanning path defining a print zone of the printer. Typically, the mid-frame provides media support at or near the print zone. A sheet feeding mechanism is used to incrementally advance the print medium sheet in a sheet feed direction, also commonly referred to as a sub-scan direction or vertical direction, through the print zone between scans in the main scan direction, or after all data intended to be printed with the print medium at a particular stationary position has been completed.

One such sheet feed mechanism includes a feed roller and corresponding pinch roller arrangement located upstream of the print zone, and an exit roller and corresponding exit pinch roller arrangement, such as a plurality of star wheels, located downstream of the print zone. The exit roller may be, either intentionally or unintentionally, slightly over-driven to place the sheet in a state of slight tension during printing. Such a sheet feed mechanism, however, does not easily permit printing near the trailing edge of the sheet, as in attempting borderless printing, since as the sheet is released from the feed roller, the sheet can lunge forward due to the state of tension of the sheet and/or the allowable play or backlash in the gear train of the sheet feed mechanism, thereby resulting in a printing defect referred to as horizontal banding. As the name implies, horizontal banding is a horizontal band across the width of the sheet of print media where a uniform swath wide dot placement error occurs due to media indexing inaccuracies. Thus, on a sheet of print media, if during printing the sheet indexes inaccurately as the sheet is released from the feed roller nip, an undesirable horizontal band will appear on the sheet.

One known gear drive system for improving the accuracy and control of media advancement and positioning includes a friction device to keep the teeth of the respective drive (feed roller) and tension (exit roller) gears meshed together with the teeth of the corresponding pinion gears of the motor, even if the motor backs up slightly. The friction device includes elements that pinch the gears of the gear train, adding friction so that when the motor stops and backs up, the gears follow it backwards, thereby keeping the gear teeth meshed together. However, such a system creates undesirable drag on the gear train, thereby increasing motor torque and, in turn, increasing the electrical energy requirements for the gear drive system.

What is needed in the art is a print media feed system that permits precise control of the position of a sheet of print media following release by the feed roller without introducing undesirable drag on the gear train.

SUMMARY OF THE INVENTION

The present invention provides a print media feed system that permits precise control of the position of a sheet of print media following release by the feed roller without introducing undesirable drag on the gear train.

The invention, in one form thereof, is directed to an imaging apparatus including a print media feed system for advancing a sheet of print media in a sheet feed direction through a print zone. The imaging apparatus includes a motor including a motor shaft to which a pinion gear is attached, and a feed roller including a shaft. The feed roller is positioned upstream from the print zone in relation to the sheet feed direction. A primary gear train includes a first plurality of gears in meshed relation. The first plurality of gears includes a first gear in mesh with the pinion gear and a second gear rigidly mounted to the shaft of the feed roller. A spring coupling is provided having a first end and a second end, the first end being connected to the second gear of the primary gear train. A secondary gear train includes a second plurality of gears in meshed relation. The second plurality of gears includes a third gear in mesh with the pinion gear and a fourth gear rotatably mounted to the shaft of the feed roller for free rotation with respect to the shaft. The second end of the spring coupling is connected to the fourth gear of the secondary gear train.

In another form thereof, the invention is directed to an imaging apparatus including a print media feed system for advancing a sheet of print media in a sheet feed direction through a print zone. The imaging apparatus includes a motor including a motor shaft to which a pinion gear is attached, and a shaft. A primary gear train includes a first plurality of gears in meshed relation. The first plurality of gears includes a first gear in mesh with the pinion gear and a second gear rigidly mounted to the shaft. A spring coupling is provided having a first end and a second end, the first end being connected to the second gear of the primary gear train. A secondary gear train includes a second plurality of gears in meshed relation. The second plurality of gears includes a third gear in mesh with the pinion gear and a fourth gear rotatably mounted to the shaft for free rotation with respect to the shaft. The second end of the spring coupling is connected to the fourth gear of the secondary gear train. An exit roller is provided having an exit roller gear. The exit roller is positioned downstream from the print zone in relation to the sheet feed direction. The exit roller gear is coupled in meshed relation to the second gear of the primary gear train via a transmission gear.

In still another form thereof, the invention is directed to a method for reducing printing defects induced by a print media feed system in an imaging apparatus, comprising the steps of providing a motor including a motor shaft to which a pinion gear is attached, wherein a rotation of the pinion gear effects a conveyance of a sheet of print media in a sheet feed direction; providing a feed roller defining in part a feed roller nip located upstream of a print zone in relation to the sheet feed direction, the feed roller including a shaft; providing an exit roller defining in part an exit roller nip located downstream of the print zone in relation to the sheet feed direction; and providing a gear train coupled to the feed roller, and coupling the feed roller via a transmission gear to the exit roller, so as to effect a rotation of the feed roller and the exit roller, the gear train being configured to prevent the sheet of print media from lunging forward when the sheet of print media is released from the feed roller nip while the sheet of print media is further conveyed by the exit roller.

An advantage of the present invention is that the configuration of the print media feed system reduces the occurrence of printing defects resulting from the sheet of print media lunging forward as the sheet is released from the feed roller nip, so as to avoid an undesirable horizontal banding on the sheet.

Another advantage of the present invention is that the configuration of the print media feed system provides precise control of the position of a sheet of print media following release by the feed roller without introducing undesirable drag on the gear train.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
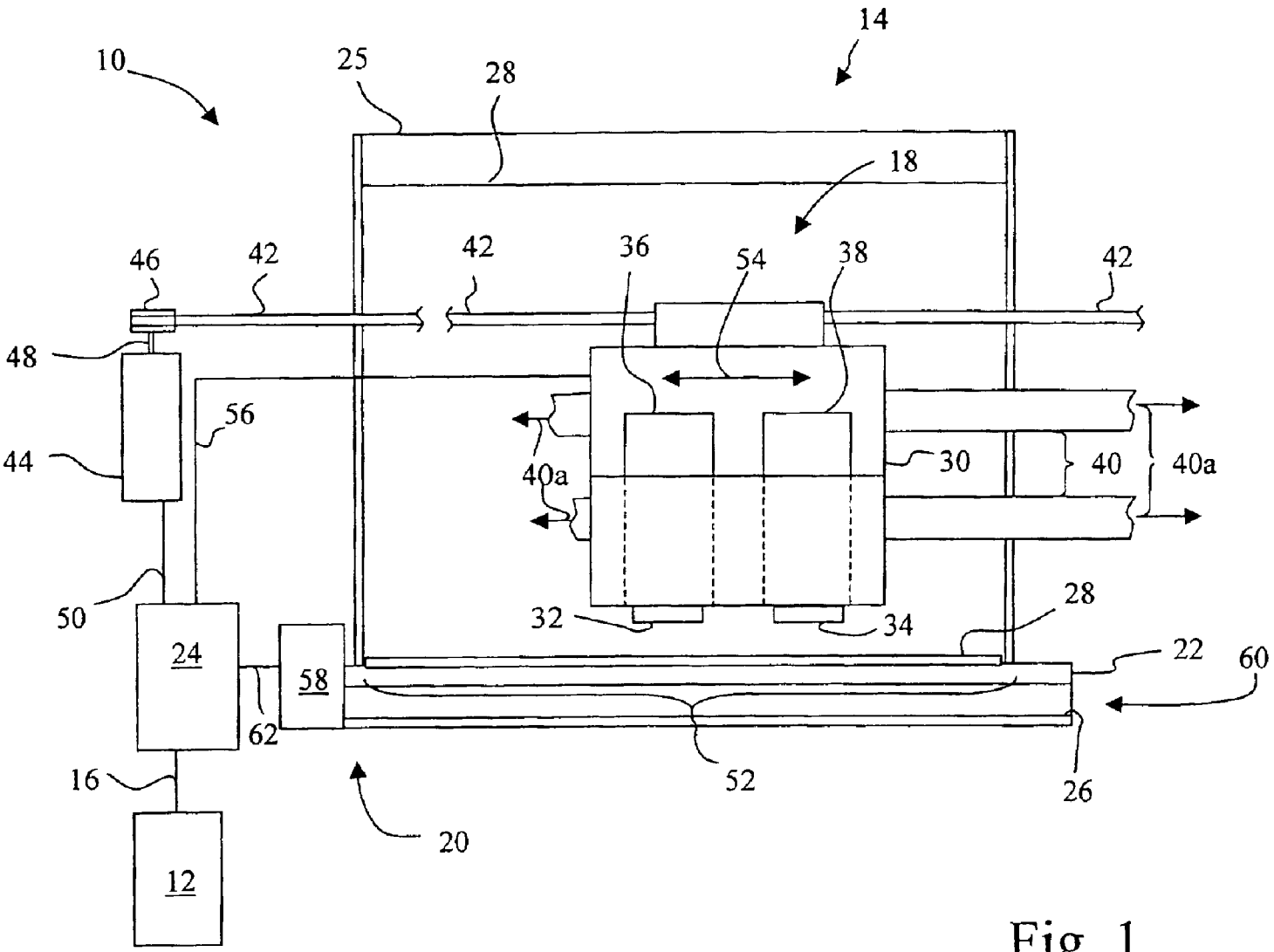
FIG. 1 is a diagrammatic representation of an imaging apparatus embodying the present invention.

Referring now to the drawings and more particularly to FIG. 1, there is shown an imaging system 10 embodying the present invention.

Imaging system 10 includes computer 12 and an imaging apparatus 14, such as for example an ink jet printer, which also will be referenced by element number 14. Computer 12 is communicatively coupled to ink jet printer 14 by way of communications link 16.

Communications link 16 may be established, for example, by a direct connection, such as a cable connection, between ink jet printer 14 and computer 12; by a wireless connection; or by a network connection, such as for example, an Ethernet local area network (LAN) or a wireless networking standard, such as IEEE 802.11.

Computer 12 is typical of that known in the art, and includes a display, an input device such as a keyboard, a processor and associated memory. Resident in the memory of computer 12 is printer driver software. The printer driver software places print data and print commands in a format that can be recognized by ink jet printer 14. The format can be, for example, a data packet including print data and printing commands for a given area such as a print scan and includes a print header that identifies the scan data.

Ink jet printer 14 includes a printhead carrier system 18, a print media feed system 20, a mid-frame 22, a controller 24, a print media source 25 and an exit tray 26.

Print media source 25 is configured and arranged to supply individual sheets of print media 28 to print media feed system 20, which in turn further transports a sheet of print media 28 during a printing operation.

Printhead carrier system 18 includes a printhead carrier 30 for carrying a color printhead 32 and black printhead 34. A color ink reservoir 36 is provided in fluid communication with color printhead 32 and a black ink reservoir 38 is provided in fluid communication with black printhead 34. Reservoirs 36, 38 may be located near respective printheads 32 and 34, which in turn may be assembled as respective unitary cartridges. Alternatively, reservoirs 36, 38 may be located remote from printheads 32, 34, e.g., off-carrier, and reservoirs 36, 38 may be fluidly interconnected to printheads 32, 34, respectively, by fluid conduits. Printhead carrier system 18 and printheads 32 and 34 may be configured for unidirectional printing or bidirectional printing.

Printhead carrier 30 is guided by a pair of guide members 40. The guide members 40 can be, for example, a pair of guide rods or alternatively, one or both of guide members 40 could be a guide rail made of a flat material, such as metal. The axes 40*a* of guide members 40 define a bidirectional-scanning path, also referred to as 40*a*, of printhead carrier 30. Printhead carrier 30 is connected to a carrier transport belt 42 that is driven by a carrier motor 44 by way of a driven carrier pulley 46. Carrier motor 44 has a rotating carrier motor shaft 48 that is attached to carrier pulley 46. Carrier motor 44 is electrically connected to controller 24 via communications link 50. At a directive of controller 24, printhead carrier 30 is transported, in a reciprocating manner, along guide members 40. Carrier motor 44 can be, for example, a direct current motor or a stepper motor.

The reciprocation of printhead carrier 30 transports ink jet printheads 32 and 34 across the sheet of print media 28 along bidirectional scanning path 40*a* to define a print zone 52 of printer 14 as a rectangular region. This reciprocation occurs in a scan direction 54 that is parallel with bidirectional scanning path 40*a* and is also commonly referred to as the horizontal scanning direction. Printheads 32 and 34 are electrically connected to controller 24 via communications link 56.

During each printing pass, i.e., scan, of printhead carrier 30, while ejecting ink from printheads 32 and/or 34, the sheet of print media 28 is held stationary by print media feed system 20. Before ink ejection begins for a subsequent pass, print media feed system 20 conveys the sheet of print media 28 in an incremental, i.e., indexed, fashion to advance the sheet of print media 28 into print zone 52. Following printing, the printed sheet of print media 28 is delivered to print media exit tray 26.

Print media feed system 20 includes a drive unit 58 coupled to a plurality of sheet conveying rollers 60. Drive unit 58 is electrically connected to controller 24 via communications link 62, and provides a rotational force which is supplied to at least some of sheet conveying rollers 60.

Figure 2:
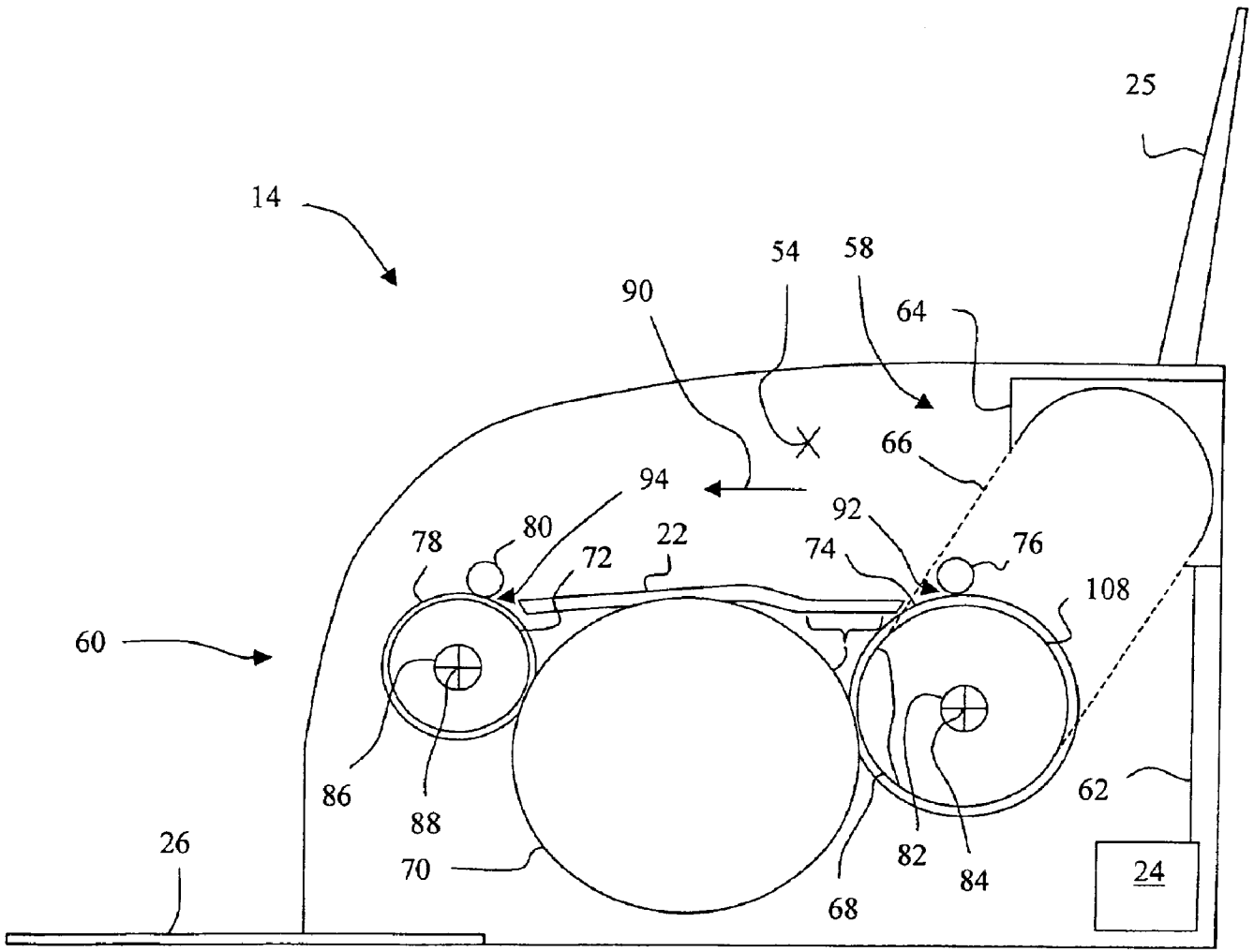
FIG. 2 is a diagrammatic side view of the print media feed system of the imaging apparatus of FIG. 1.
Figure 3:
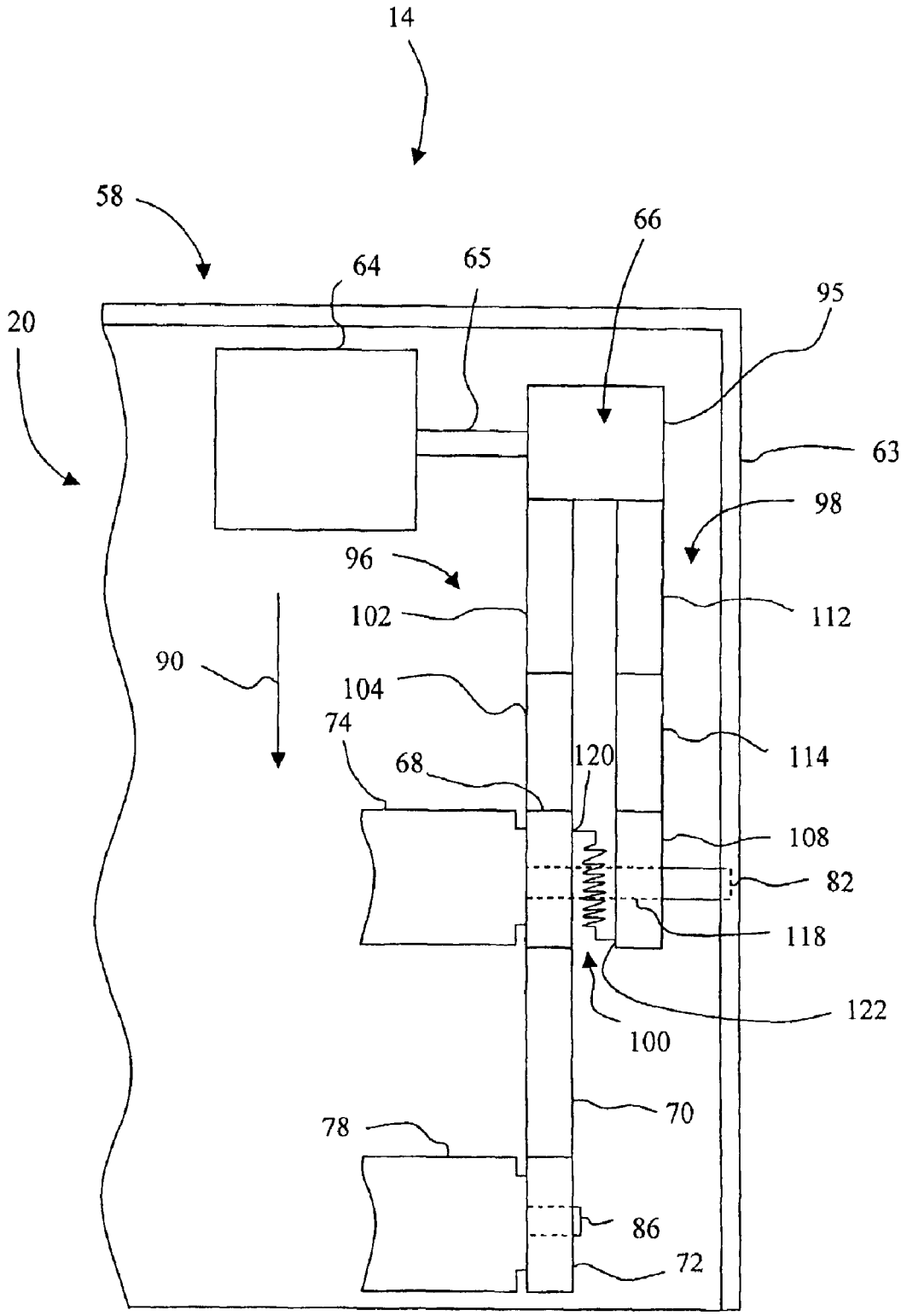
FIG. 3 is a diagrammatic top view of the print media feed system of FIG. 1.

Referring to FIGS. 2 and 3, there is shown diagrammatic representations of imaging apparatus 14 including print media feed system 20. As shown in FIG. 3, print media drive system 20 is mounted to a printer frame 63.

Drive unit 58 includes a motor 64, a gear train 66 including a feed roller gear 68, a transmission gear 70, an exit roller gear 72. Motor 64 can be, for example, a direct current motor or a stepper motor. Sheet conveying rollers 60 includes a feed roller 74, a feed pinch roller arrangement 76, an exit roller 78, and an exit pinch roller arrangement 80. Feed roller 74 includes a shaft 82 defining an axis of rotation 84, with feed roller 74 and shaft 82 being rigidly coupled, such as by a friction fit. Exit roller 78 includes a shaft 86 defining an axis of rotation 88, with exit roller 78 and shaft 86 being rigidly coupled, such as by a friction fit. Each of shafts 82, 88 are respectively mounted to frame 63 of imaging apparatus 14 via suitable bushing or bearing arrangements, which are well known in the art.

In the diagrammatic side view of imaging apparatus 14 of FIG. 2, it becomes apparent that print zone 52 is two dimensional, i.e., having a length extending in scanning direction 54 (FIG. 1), and a width extending in a sheet feed direction 90 (FIG. 2). In FIG. 2, scanning direction 54 is represented as an X to represent an orientation extending into and out of the drawing sheet of FIG. 2.

Feed pinch roller arrangement 76 is positioned adjacent to feed roller 74. Feed pinch roller arrangement 76 and adjacent feed roller 74 are oriented to define a feed roller nip 92 to advance a leading edge of the sheet of print media 28 through print zone 52.

Exit pinch roller arrangement 80 is positioned adjacent to exit roller 78. Exit pinch roller arrangement 80 and adjacent exit roller 78 are oriented to define an exit roller nip 94 that advances a trailing edge of the sheet of print media 28 through print zone 52 when feed roller nip 92 releases the sheet of print media 28.

Feed roller 74 is positioned upstream from print zone 52 in relation to sheet feed direction 90. Exit roller 78 is positioned downstream from print zone 52 in relation to sheet feed direction 90. Further, it is noted that axes 84 and 88 of shafts 82 and 86, respectively, are arranged substantially parallel to scanning direction 54, and arranged substantially perpendicular to sheet feed direction 90.

Feed roller gear 68 is rigidly mounted to shaft 82 of feed roller 74, such that feed roller gear 68 and feed roller 74 rotate together as a unit. The term "rigidly mounted" is used for convenience to encompass any of a number of fixed attachment methods such as for example, the unitary molding of feed roller gear 68 to feed roller 74, the thermal welding of feed roller gear 68 to shaft 82 of feed roller 74, providing a spline coupling between feed roller gear 68 and shaft 82, providing a keyed coupling between feed roller gear 68 and shaft 82, providing a set screw attachment of feed roller gear 68 to shaft 82, friction fit, etc.

Exit roller gear 72 is rigidly mounted to shaft 86 of exit roller 78, such that exit roller gear 72 and exit roller 78 rotate together as a unit. The term "rigidly mounted" is used for convenience to encompass any of a number of fixed attachment methods such as for example, the unitary molding of exit roller gear 72 to exit roller 78, the thermal welding of exit roller gear 72 to shaft 86 of exit roller 78, providing a spline coupling between exit roller gear 72 and shaft 86, providing a keyed coupling between exit roller gear 72 and shaft 86, providing a set screw attachment of exit roller gear 72 to shaft 86, friction fit, etc.

In the arrangement, as shown in FIGS. 2 and 3, exit roller gear 72 is coupled in meshed relation to feed roller gear 68 via transmission gear 70. The number of teeth of each of feed roller gear 68 and exit roller gear 72 are selected so that the respective surface rotational velocities of feed roller 74 and exit roller 78 are preferably equal, but at least substantially equal. By substantially equal, it is meant that the respective surface rotational velocities are within ±0.1 percent.

Referring now to FIG. 3, motor 64 includes a motor shaft 65 to which a pinion gear 95 is attached. Gear train 66 includes a primary gear train 96, a secondary gear train 98 and a spring coupling 100. Pinion gear 95 is in meshed relation to each of primary gear train 96 and secondary gear train 98.

Primary gear train 96 includes a first plurality of gears in meshed relation, and in particular, includes feed roller gear 68, an intermediate gear 102 and an intermediate gear 104. Intermediate gear 102 is in mesh with pinion gear 95. Further, intermediate gear 102 is in mesh with intermediate gear 104, which in turn is in mesh with feed roller gear 68, which in turn is in mesh with transmission gear 70, which in turn is in mesh with exit roller gear 72. Since feed roller gear 68 is rigidly mounted to shaft 82 of feed roller 74, a rotation of pinion gear 95 is translated into a rotation of feed roller 74 via intermediate gear 102, intermediate gear 104 and feed roller gear 68. Further, since exit roller gear 72 is rigidly mounted to shaft 86 of exit roller 78, a rotation of pinion gear 95 is translated into a rotation of exit roller 78 via intermediate gear 102, intermediate gear 104, feed roller gear 68, transmission gear 70 and exit roller gear 72.

In order to reduce the occurrence of print media defects, such as horizontal banding, when the sheet of print media is released from feed roller nip 92, secondary gear train 98 is arranged in parallel with primary gear train 96. Secondary gear train 98 includes a torque conveyance gear 108, an intermediate gear 112 and an intermediate gear 114. It is noted that in FIG. 2, a portion of torque conveyance gear 108 is broken away to expose feed roller gear 68. Intermediate gear 112 is in mesh with pinion gear 95. Further, intermediate gear 112 is in mesh with intermediate gear 114, which in turn is in mesh with torque conveyance gear 108. Torque conveyance gear 108 has a center bore 118 having an inside diameter that is slightly larger than the outside diameter of the corresponding portion of shaft 82 of feed roller 74, thereby permitting torque conveyance gear 108 to freely rotate on shaft 82.

In FIG. 3, spring coupling 100 is shown schematically. Spring coupling 100 has a first end 120 and a second end 122. The first end 120 of spring coupling 100 is attached to feed roller gear 68, and the second end 122 of spring coupling 100 is attached to torque conveyance gear 108. Spring coupling 100 provides a torsion force to remove any gear backlash between pinion gear 95 and feed roller gear 68, and in turn reduces or eliminates the sheet lunging effect that occurs when the sheet of print media is released from feed roller nip 92 and further conveyed by exit roller 78.

In gear train 66, primary gear train 96 and secondary gear train 98 need not be of the same gear-to-gear ratio, so long as the overall velocity ratio between pinion gear 95 and feed roller shaft 82 are the same. In order to minimize gear wear in gear train 66, it is desirable to reduce the amount of torsion force supplied by spring coupling 100 to the minimum amount possible while still reducing the undesirable printing defects, such as horizontal banding, to an acceptable level. Further, since feed roller shaft 82 is not driven by secondary gear train 98, the quality of the gears in secondary gear train 98 need not be as high as that of the gears in primary gear train 96.

The operation of drive unit 58 will now be described with reference to FIGS. 1–3. Controller 24 supplies control signals to motor 64, which responds with the rotation of motor shaft 65, which in turn rotates pinion gear 95. In turn, pinion gear 95 simultaneously rotates the gears of primary gear train 96 and secondary gear train 98. In particular, pinion gear 95 rotates intermediate gear 102, which in turn rotates intermediate gear 104, which in turn rotates feed roller gear 68 (and associated feed roller 74), which in turn rotates transmission gear 70, which in turn rotates exit roller gear 72 (and associated exit roller 78). Simultaneously, pinion gear 95 rotates intermediate gear 112, which in turn rotates intermediate gear 114, which in turn rotates torque conveyance gear 108, which in turn is coupled via spring coupling 100 to feed roller gear 68. As a result, the torsion force exerted by spring coupling 100 to feed roller gear 68 tends to wind up all the backlash in the six meshes, i.e., pinion gear 95 and all the gears 102, 104 and 68 of primary gear train 96 are maintained in mesh as well as pinion gear 95 and all the gears 112, 114 and 108 of secondary gear train 98, even during times of dynamic instability, such as when the sheet of print media 28 is released from feed roller nip 92 while being further conveyed by exit roller 78. As a result, the sheet of print media 28 does not tend to lunge forward when the sheet of print media 28 is released from feed roller nip 92 while being further conveyed by exit roller 78, thereby reducing or eliminating the horizontal banding which would typically occur during this event.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus including a print media feed system for advancing a sheet of print media in a sheet feed direction through a print zone, comprising:

a motor including a motor shaft to which a pinion gear is attached;

a feed roller including a shaft, said feed roller being positioned upstream from said print zone in relation to said sheet feed direction;

a primary gear train including a first plurality of gears in meshed relation, said first plurality of gears including a first gear in mesh with said pinion gear and a second gear rigidly mounted to said shaft of said feed roller;

a spring coupling having a first end and a second end, said first end being connected to said second gear of said primary gear train;

a secondary gear train including a second plurality of gears in meshed relation, said second plurality of gears including a third gear in mesh with said pinion gear and a fourth gear rotatably mounted to said shaft of said feed roller for free rotation with respect to said shaft, said second end of said spring coupling being connected to said fourth gear of said secondary gear train.

2. The imaging apparatus of claim 1, further comprising an exit roller having an exit roller gear, said exit roller being positioned downstream from said print zone in relation to said sheet feed direction, said exit roller gear being coupled in meshed relation to said second gear of said primary gear train via a transmission gear.

3. The imaging apparatus of claim 1, further comprising a feed pinch roller arrangement positioned adjacent said feed roller, said feed roller and said feed pinch roller arrangement being oriented to define a feed roller nip to advance a leading edge of said sheet of print media through said print zone.

4. The imaging apparatus of claim 3, further comprising an exit pinch roller arrangement positioned adjacent said exit roller, said exit roller and said exit pinch roller arrangement being oriented to define an exit roller nip that advances a trailing edge of said sheet of print media through said print zone when said feed roller nip releases said sheet of print media.

5. An imaging apparatus including a print media feed system for advancing a sheet of print media in a sheet feed direction through a print zone, comprising:

a motor including a motor shaft to which a pinion gear is attached;

a shaft;

a primary gear train including a first plurality of gears in meshed relation, said first plurality of gears including a first gear in mesh with said pinion gear and a second gear rigidly mounted to said shaft;

a spring coupling having a first end and a second end, said first end being connected to said second gear of said primary gear train;

a secondary gear train including a second plurality of gears in meshed relation, said second plurality of gears including a third gear in mesh with said pinion gear and a fourth gear rotatably mounted to said shaft for free rotation with respect to said shaft, said second end of said spring coupling being connected to said fourth gear of said secondary gear train; and an exit roller having an exit roller gear, said exit roller being positioned downstream from said print zone in relation to said sheet feed direction, said exit roller gear being coupled in meshed relation to said second gear of said primary gear train via a transmission gear.

6. The imaging apparatus of claim 5, further comprising a feed roller rigidly coupled to said shaft, said feed roller being positioned upstream from said print zone in relation to said sheet feed direction.

7. The imaging apparatus of claim 6, further comprising a feed pinch roller arrangement positioned adjacent said feed roller, said feed roller and said feed pinch roller arrangement being oriented to define a feed roller nip to advance a leading edge of said sheet of print media through said print zone.

8. The imaging apparatus of claim 7, further comprising an exit pinch roller arrangement positioned adjacent said exit roller, said exit roller and said exit pinch roller arrangement being oriented to define an exit roller nip that advances a trailing edge of said sheet of print media through said print zone when said feed roller nip releases said sheet of print media.

* * * * *